US011276942B2

(12) United States Patent
Wong et al.

(10) Patent No.: US 11,276,942 B2
(45) Date of Patent: Mar. 15, 2022

(54) HIGHLY-INTEGRATED MULTI-ANTENNA ARRAY

(71) Applicant: INDUSTRIAL TECHNOLOGY RESEARCH INSTITUTE, Hsinchu (TW)

(72) Inventors: Kin-Lu Wong, Kaohsiung (TW); Wei-Yu Li, Yilan (TW); Wei Chung, Hengshan Township (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 16/728,926

(22) Filed: Dec. 27, 2019

(65) Prior Publication Data

US 2021/0203080 A1 Jul. 1, 2021

(51) Int. Cl.
*H01Q 21/06* (2006.01)

(52) U.S. Cl.
CPC ..... *H01Q 21/064* (2013.01)

(58) Field of Classification Search
CPC ..... H01Q 21/0043; H01Q 21/005; H01Q 21/0062; H01Q 21/0064; H01Q 13/085; H01Q 13/10; H01Q 13/106; H01Q 19/13
See application file for complete search history.

(56) References Cited

U.S. PATENT DOCUMENTS 4,460,899 A 7/1984 Schmidt et al.
4,590,478 A * 5/1986 Powers ..... H01Q 13/106 343/700 MS (Continued)

FOREIGN PATENT DOCUMENTS

CN 102456945 B 11/2014
CN 102570058 B 11/2014

(Continued)

OTHER PUBLICATIONS

Abedin et al., "Effects of EBG Reflection Phase Profiles on the Input Impedance and Bandwidth of Ultrathin Directional Dipoles," IEEE Transactions on Antennas and Propagation, vol. 53, No. 11, Nov. 2005, pp. 3664-3672.

(Continued)

*Primary Examiner* — Jason Crawford
(74) *Attorney, Agent, or Firm* — Birch, Stewart, Kolasch & Birch, LLP

(57) ABSTRACT

A highly-integrated multi-antenna array comprising a first conductor layer, a second conductor layer, a plurality of conjoined conducting structures, a plurality of slot antennas, and a conjoined slot structure is provided. The first conductor layer and the second conductor layer are spaced apart by a first interval, and are electrically connected by the conjoined conducting structures. Each slot antenna has a radiating slot structure and a signal coupling line, which partially overlap or cross each other. All radiating slot structures are formed at the second conductor layer. Each signal coupling line is spaced apart from the second conductor layer by a coupling interval and has a signal feeding point. Each slot antenna is excited to generate at least one resonant mode covering at least one identical first communication band. The conjoined slot structure is formed at the second conductor layer and connects with all radiating slot structures.

12 Claims, 6 Drawing Sheets

(56) References Cited

U.S. PATENT DOCUMENTS

| | | | | |
|---|---|---|---|---|
| 5,241,321 | A * | 8/1993 | Tsao | H01Q 9/0435 343/700 MS |
| 5,489,913 | A * | 2/1996 | Raguenet | H01Q 13/18 343/767 |
| 5,952,983 | A | 9/1999 | Dearnley et al. | |
| 5,990,838 | A | 11/1999 | Burns et al. | |
| 6,104,348 | A | 8/2000 | Karlsson et al. | |
| 6,288,679 | B1 * | 9/2001 | Fischer | H01Q 9/0428 343/700 MS |
| 6,344,829 | B1 | 2/2002 | Lee | |
| 6,426,723 | B1 | 7/2002 | Smith et al. | |
| 6,518,930 | B2 | 2/2003 | Itoh et al. | |
| 6,593,891 | B2 * | 7/2003 | Zhang | H01Q 1/246 343/767 |
| 6,778,144 | B2 * | 8/2004 | Anderson | H01Q 13/106 343/767 |
| 7,250,910 | B2 | 7/2007 | Yoshikawa et al. | |
| 7,271,777 | B2 | 9/2007 | Yuanzhu | |
| 7,330,156 | B2 | 2/2008 | Arkko et al. | |
| 7,352,328 | B2 | 4/2008 | Moon et al. | |
| 7,382,320 | B2 * | 6/2008 | Chang | H01Q 1/2216 343/700 MS |
| 7,385,563 | B2 | 6/2008 | Bishop | |
| 7,405,699 | B2 | 7/2008 | Qin | |
| 7,450,071 | B1 * | 11/2008 | Volman | H01Q 1/02 343/700 MS |
| 7,460,069 | B2 | 12/2008 | Park et al. | |
| 7,498,997 | B2 | 3/2009 | Moon et al. | |
| 7,541,988 | B2 | 6/2009 | Sanelli et al. | |
| 7,561,110 | B2 | 7/2009 | Chen | |
| 7,573,433 | B2 | 8/2009 | Qin | |
| 7,586,445 | B2 | 9/2009 | Qin et al. | |
| 7,589,676 | B2 * | 9/2009 | Popugaev | H01Q 9/0414 343/700 MS |
| 7,609,221 | B2 | 10/2009 | Chung et al. | |
| 7,659,860 | B2 * | 2/2010 | Manholm | H01Q 13/106 343/769 |
| 7,688,273 | B2 | 3/2010 | Montgomery et al. | |
| 7,710,343 | B2 | 5/2010 | Chiu et al. | |
| 7,714,789 | B2 | 5/2010 | Tsai et al. | |
| 7,733,285 | B2 | 6/2010 | Gainey et al. | |
| 8,629,812 | B2 * | 1/2014 | Jaffri | H01Q 13/18 343/770 |
| 10,103,445 | B1 | 10/2018 | Gregoire et al. | |
| 11,018,719 | B2 * | 5/2021 | Sarabandi | H01Q 21/0006 |
| 2002/0021255 | A1 * | 2/2002 | Zhang | H01Q 5/385 343/770 |
| 2002/0044098 | A1 * | 4/2002 | Von Stein | H01Q 1/38 343/770 |
| 2005/0200543 | A1 * | 9/2005 | Shtrikman | H01Q 13/10 343/767 |
| 2009/0322639 | A1 | 12/2009 | Lai | |
| 2010/0134377 | A1 | 6/2010 | Tsai et al. | |
| 2010/0156745 | A1 | 6/2010 | Andrenko et al. | |
| 2010/0156747 | A1 | 6/2010 | Montgomery | |
| 2010/0238079 | A1 | 9/2010 | Ayatollahi et al. | |
| 2010/0295736 | A1 | 11/2010 | Su | |
| 2010/0295750 | A1 | 11/2010 | See et al. | |
| 2011/0175790 | A1 * | 7/2011 | Yanagi | H01Q 1/2225 343/857 |
| 2012/0169552 | A1 * | 7/2012 | Lee | H01Q 9/285 343/727 |
| 2015/0229026 | A1 * | 8/2015 | Lindmark | H01Q 21/24 343/770 |
| 2016/0294065 | A1 * | 10/2016 | Lindmark | H01Q 21/08 |
| 2017/0244171 | A1 * | 8/2017 | Lee | H01Q 5/30 |
| 2018/0301817 | A1 | 10/2018 | Ichinose et al. | |
| 2021/0203080 | A1 * | 7/2021 | Wong | H01Q 21/28 |

FOREIGN PATENT DOCUMENTS

| | | | |
|---|---|---|---|
| CN | 105322282 | B | 1/2018 |
| CN | 107768811 | A | 3/2018 |
| TW | I352455 | B | 11/2011 |
| TW | I374572 | B | 10/2012 |
| TW | I383540 | B1 | 1/2013 |
| TW | I495197 | B | 8/2015 |
| TW | M584024 | U | 9/2019 |

OTHER PUBLICATIONS

Bae et al.,"Compact Mobile Handset MIMO Antenna for LTE700 Applications," Microwave and Optical Technology Letters, vol. 52, No. 11, Nov. 2010, pp. 2419-2422.

Cai et al., "A Novel Wideband Diversity Antenna for Mobile Handsets," Microwave and Optical Technology Letters, vol. 51, No. 1, Jan. 2009, pp. 218-222.

Chen et al., "A Decoupling Technique for Increasing the Port Isolation Between Two Strongly Coupled Antennas," IEEE Transactions on Antennas and Propagation, vol. 56, No. 12, Dec. 2008, pp. 3650-3658.

Choi et al., Performance Evaluation of 2 × 2 MIMO Handset Antenna Arrays for Mobile WiMAX Applications,' Microwave and Optical Technology Letters, vol. 51, No. 6, Jun. 2009, pp. 1558-1561.

Chou et al., "Interantional Wideband Monopole Antenna for MIMO Access-Point Applications in the WLAN/WIMAX Bands," Microwave and Optical Techology Letters, vol. 50, No. 5, May 2008, pp. 1146-1148.

Coetzee et al., "Compact Multiport Antenna with Isolated Ports," Microwave and Optical Technology Letters, vol. 50, No. 1, Jan. 2006, pp. 229-232.

Ding et al., "A Novel Dual-Band Printed Diveristy Antenna for Mobile Terminals," IEEE Transactions on Antennas and Propagation, vol. 55, No. 7, Jul. 2007, pp. 2088-2096.

Ethier et al., "MIMO Handheld Antenna Design Approach Using Characterisitc Mode Concepts," Microwave and Optical Technology Letters, vol. 50, No. 7, Jul. 2008, pp. 1724-1727.

Gao et al., "A Compact UWB and Bluetooth Slot Antenna for MIMO/Diversity Applications," ETRI Journal, vol. 36, No. 2, Apr. 2014, pp. 309-312.

Gao et al., "Compact Printed UWB Diveristy Slot Antenna With 5.5-GHz Band-Notched Characteristics," IEEE Antennas and Wireless Propagation Letters, vol. 13, 2014, pp. 376-379.

Han et al., "MIMO Antenna Using a Decoupling Network for 4G USB Dongle Application," Microwave and Optical Technology Letters, vol. 52, No. 11, Nov. 2010, pp. 2551-2554.

Kang et al., "Compact Offset Microstrip-Fed MIMO Antenna for Band-Notched UWB Applications," IEEE Antennas and Wireless Propagation Letters, vol. 14, 2015, pp. 1754-1757.

Kang et al., "Isolation Improvement of 2.4/5.2/5.8 GHz WLAN Internal Laptop Computer Antennas Using Dual-Band Strip Resonator as a Wavetrap," Microwave and Optical Technology Letters, vol. 52, No. 1, pp. 58-64.

Karimian et al., "Novel F-Shaped Quad-Band Printed Slot Antenna for WLAN and WiMAX MIMO Systems," IEEE Antennas and Wireless Propagation Letters, vol. 12, 2013, pp. 405-408.

Kim et al., "A Parallel-Plate-Mode Suppressed Meander Slot Antenna With Plated-Through-Holes," IEEE Antennas and Wireless Propagation Letters, vol. 4, 2005, pp. 118-120.

Kim et al., "Design of a Dual-Band MIMO Antenna for Mobile WiMAX Application," Microwave and Optical Technology Letters, vol. 53, No. 2, Feb. 2011, pp. 410-414.

Liu et al., "A Compact Wideband Planar Diversity Antenna for Mobile Handsets," Microwave and Optical Technology Letters, vol. 50, No. 1, Jan. 2008, pp. 87-91.

Liu et al., "An Extremely Low-Profile Wideband MIMO Antenna for 5G Smartphones," IEEE Transactions on Antennas and Propagation, vol. 67, No. 9, Sep. 2019, pp. 5772-5780.

Liu et al., "Compact Differential Band-Notched Stepped-Slot UWB-MIMO Antenna With Common-Mode Suppression," IEEE Antennas and Wireless Propagation Letters, vol. 16, 2017, pp. 593-596.

Luo et al., "Isolation Enhancement of a Very Compact UWB-MIMO Slot Antenna With Two Defected Ground Structures," IEEE Antennas and Wireless Propagation Letters, vol. 14, 2015, pp. 1766-1769.

(56) References Cited

OTHER PUBLICATIONS

Payandehjoo et al., "Employing EBG Structures in Multiantenna Systems for Improving Isolation and Diversity Gain." IEEE Antennas and Wireless Propagation, vol. 8, 2009, pp. 1162-1165.
Payandehjoo et al., "Suppression of Substrate Coupling Between Slot Antennas Using Electromagnetic Bandgap Structures," IEEE, 2008, 4 pages.
Sarrazin et al., "Investigation on Cavity/Slot Antennas for Diversity and MIMO Systems: The Example of a Three-Port Antenna," IEEE Antennas and Wireless Propagation Letters, vol. 7, 2008, pp. 414-417.
Sharawi et al., "A Two Concentric Slot Loop Based Connected Array MIMO Antenna System for 4G/5G Terminals," IEEE Transactions on Antennas and Propagation, vol. 65, No. 12, Dec. 2017, pp. 6679-6686.
Srivastava et al., "Compact MIMO Slot Antenna for UWB Applications," IEEE Antennas and Wireless Propagation Letters, vol. 15, 2016, pp. 1057-1060.
Su et al., "Printed Coplanar Two-Antenna Element For 2.4/5 GHz WLAN Operation in MIMO System," Microwave and Optical Letters, vol. 50, No. 6, Jun. 2008, pp. 1635-1638.
Su, "A Three-In-One Diversity Antenna System for 5GHz WLAN Applications," Microwave and Optical Technology Letters, vol. 51, No. 10, Oct. 2009, pp. 2477-2481.
Su, "Concurrent Dual-Band Six-Loop-Antenna System with Wide 3-dB Beamwidth Radiation for MIMO Access Points," Microwave and Optical Technology Letters, vol. 52, No. 6, Jun. 2010, pp. 1253-1258.
Yang et al., "Reflection Phase Characterizations of the EBG Ground Plane for Low Profile Wire Antenna Applications," IEEE Transactions on Antennas and Propagation, vol. 51, No. 10, Oct. 2003, pp. 2691-2703.
Taiwanese Notice of Allowance and Search Report, dated Aug. 26, 2020, for Taiwanese Application No. 108147962.

* cited by examiner

HIGHLY-INTEGRATED MULTI-ANTENNA ARRAY

TECHNICAL FIELD

The invention relates in general to a highly-integrated multi-antenna design, and more particularly to a structure of a highly-integrated multi-antenna array capable of increasing data transmission rate.

BACKGROUND OF THE INVENTION

Due to the increasing demands for signal quality and high data rate in wireless communication, the multi-input multi-output (MIMO) multi-antenna technology has gained rapid development. The multi-input multi-output (MIMO) antenna technology, having the potential to increase spectrum efficiency, channel capacity and data transmission rate as well as the reliability in the reception of communication signals, has become a focus in the development of communication system with multi-Gbps wireless data transmission rate.

However, it would be a difficult challenge to successfully apply the multi-antenna array technology in various wireless communication devices or equipment and also design the multi-antenna array to be with the advantages of good impedance matching, high integration, thin type, and high resistance to surrounding coupling interference. Meanwhile, it would be an imminent issue needed to be resolved. A plurality of adjacent antennas with identical operating band may generate problems of mutual coupling or surrounding coupling interference, which may increase the envelop correlation coefficient (ECC) between the adjacent antennas and then cause the decay on antenna radiation performances. Therefore, wireless data transmission rate would decrease, and the challenge for achieving integration design of multiple antennas would become even more difficult.

Some open literatures of the prior art already provide designs of configuring periodic structures on the ground part between multiple antennas as an energy isolator to increase the energy isolation between multiple antennas and resistances to surrounding interference. However, such designs may cause unstable factors in the manufacturing process and increase the manufacturing cost in mass production. Furthermore, such designs may excite extra coupling current and increase the ECC between multiple antennas. Additionally, such designs may increase the overall size of the multi-antenna array, and therefore would be difficult to be used in various wireless devices or equipment.

Therefore, it would be a prominent task for the industries to provide a design capable of resolving the above problems and satisfying the practical requirements of multi-antenna communication devices or apparatus achieving high wireless data transmission rates.

SUMMARY OF THE INVENTION

The invention is directed to a highly-integrated multi-antenna array. Based on some practical examples of the embodiments of the present disclosure, the highly-integrated multi-antenna array could solve the above problems.

According to one embodiment of the present invention, a highly-integrated multi-antenna array comprising a first conductor layer, a second conductor layer, a plurality of conjoined conducting structures, a plurality of slot antennas, and a conjoined slot structure is provided. The second conductor layer is spaced apart from the first conductor layer by a first interval. All of the conjoined conducting structures electrically connect the first conductor layer and the second conductor layer. Each of the slot antennas has a radiating slot structure and a signal coupling line, which partially overlap or cross each other. All of the radiating slot structures are formed at the second conductor layer. Each of the signal coupling lines is spaced apart from the second conductor layer by a coupling interval, and has a signal feeding point. Each of the slot antennas is excited to generate at least one resonant mode covering at least one identical first communication band. The conjoined slot structure is formed at the second conductor layer and connects with all of the radiating slot structures respectively.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1A:
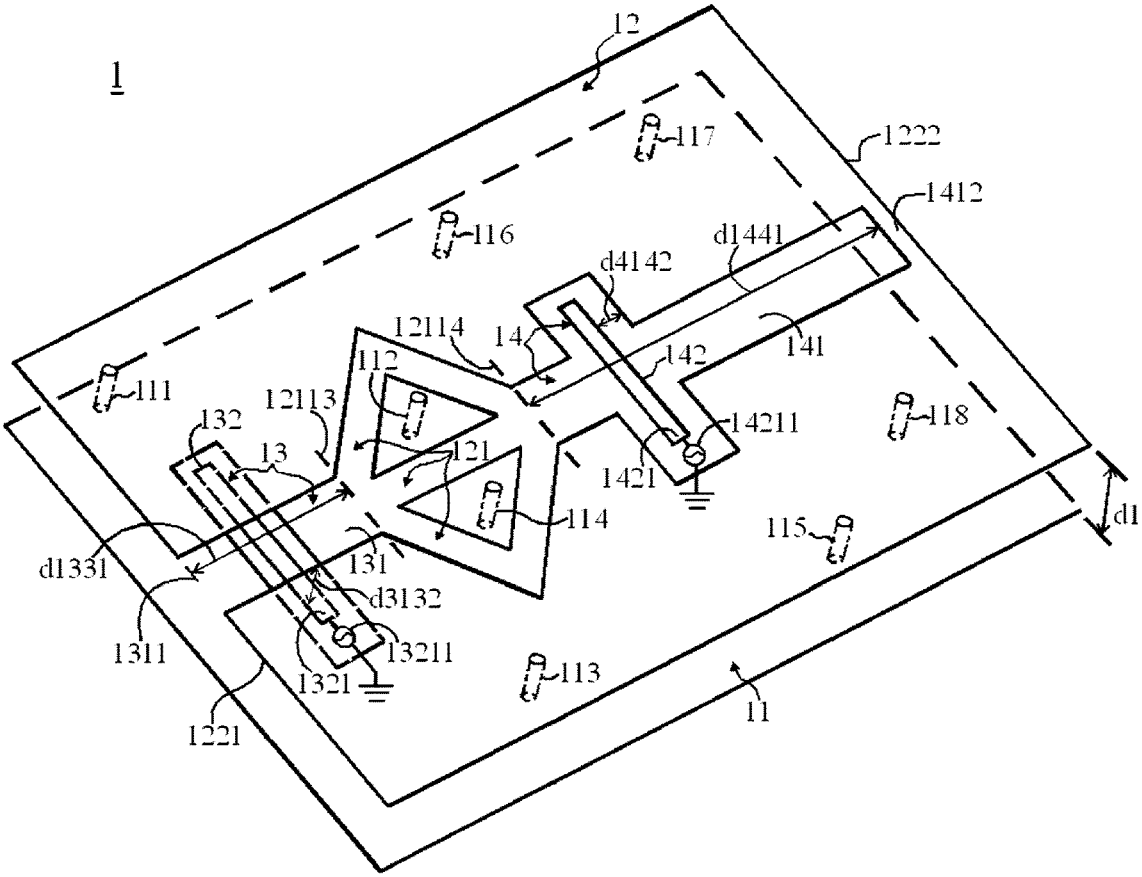
FIG. 1A is a structural diagram of a highly-integrated multi-antenna array 1 according to an embodiment of the present disclosure.

The present disclosure provides an embodiment of a highly-integrated multi-antenna array. The highly-integrated multi-antenna array includes a first conductor layer, a second conductor layer, a plurality of conjoined conducting structures, a plurality of slot antennas and a conjoined slot structure. The second conductor layer is spaced apart from the first conductor layer by a first interval. All of the conjoined conducting structures electrically connect the first conductor layer and the second conductor layer. Each of the slot antennas has a radiating slot structure and a signal coupling line, which partially overlap or cross each other. All of the radiating slot structures are formed at the second conductor layer. Each of the signal coupling lines is spaced apart from the second conductor layer by a coupling interval and has a signal feeding point. Each of the slot antennas is excited to generate at least one resonant mode covering at least one identical first communication band. The conjoined slot structure is formed at the second conductor layer and connects with all of the radiating slot structures respectively.

In order to achieve the effects of high integration, thin type, or low profile, the present disclosure provides a highly-integrated multi-antenna array. With the design that all of the radiating slot structures are formed at the second conductor layer and the design that all of the conjoined conducting structures electrically connect the first conductor layer and the second conductor layer, the first conductor layer could equivalently form a reflective layer of radiating energy and a shielding layer of surrounding coupling energy for the multi-antenna array, and therefore could successfully direct the radiating energy of the multi-antenna array to be away from the interference of surrounding coupling energy. Moreover, with the design that the radiating slot structure and the signal coupling line of each slot antenna partially overlap or cross each other and the design that each of the signal coupling lines is spaced apart from the second conductor layer by a coupling interval being in a range of 0.001 to 0.035 wavelength of the lowest operating frequency of the first communication band and with the design that a conjoined slot structure is formed at the second conductor layer and connects with all of radiating slot structures respectively, the conjoined slot structure could effectively reduce the equivalent parasitic capacitive effects of the multi-antenna array and successfully compensate the coupling capacitive effects generated between the first conductor layer and the second conductor layer. Therefore, each of the slot antennas could be excited to generate at least one resonant mode with good impedance matching covering at least one identical first communication band. Moreover, the first interval would only need to be in a range of 0.001 to 0.038 wavelength of the lowest operating frequency of the first communication band. Therefore, the invention could achieve the characteristics of good matching, high integration and low profile successfully.

Figure 1B:
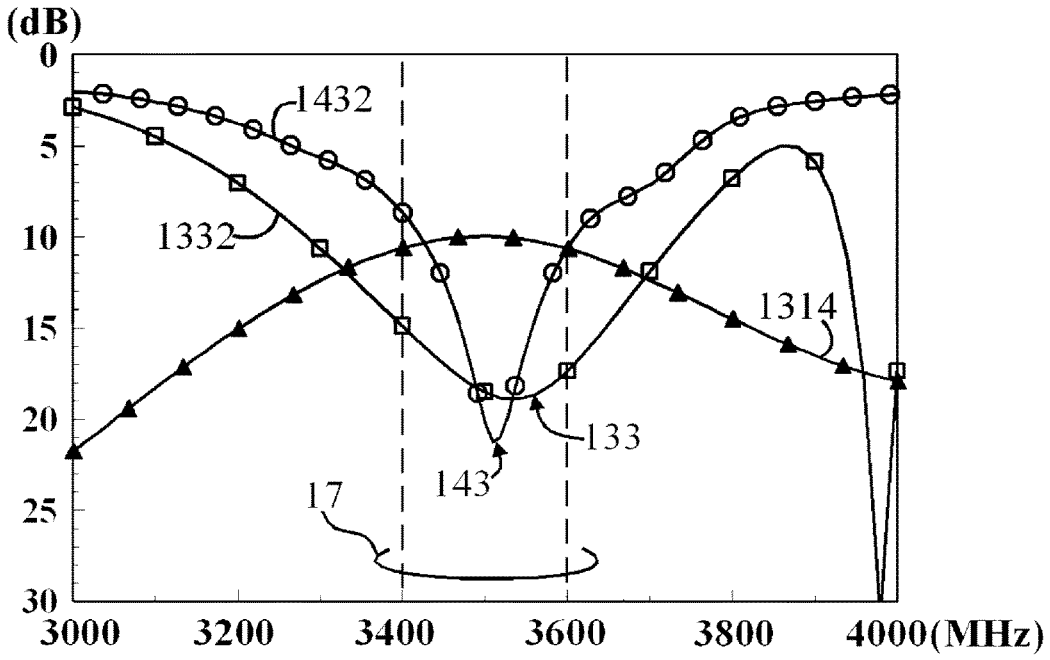
FIG. 1B is a curve diagram about return loss and isolation of a highly-integrated multi-antenna array 1 according to an embodiment of the present disclosure.

FIG. 1A is a structural diagram of a highly-integrated multi-antenna array 1 according to an embodiment of the present disclosure. As indicated in FIG. 1A, the highly-integrated multi-antenna array 1 comprises a first conductor layer 11, a second conductor layer 12, a plurality of conjoined conducting structures 111, 112, 113, 114, 115, 116, 117 and 118, a plurality of slot antennas 13 and 14, and a conjoined slot structure 121. The second conductor layer 12 is spaced apart from the first conductor layer 11 by a first interval d1. All of the conjoined conducting structures 111, 112, 113, 114, 115, 116, 117 and 118 electrically connect the first conductor layer 11 and the second conductor layer 12. All of the conjoined conducting structures 111, 112, 113, 114, 115, 116, 117 and 118 are conductive wires. The slot antennas 13 and 14 respectively have radiating slot structures 131 and 141 and signal coupling lines 132 and 142. The radiating slot structure 131 and the signal coupling line 132 cross each other. The radiating slot structure 141 and the signal coupling line 142 partially overlap each other. Both the radiating slot structures 131 and 141 are formed at the second conductor layer 12. The signal coupling lines 132 and 142 respectively are spaced apart from the second conductor layer 12 by coupling intervals d3132 and d4142, and respectively have signal feeding points 1321 and 1421 electrically coupled to signal sources 13211 and 14211. Each of the signal sources 13211 and 14211 could be an impedance matching circuit, a transmission line, a micro-strip transmission line, a strip line, a substrate integrated waveguide, a coplanar waveguide, an amplifier circuit, an integrated circuit chip or an RF module. The slot antennas 13 and 14 respectively are excited to generate at least resonant modes 133 and 143 covering at least one identical first communication band 17 (as indicated in FIG. 1B). The conjoined slot structure 121 is formed at the second conductor layer 12 and connects with both of the radiating slot structures 131 and 141. The conjoined slot structure 121 is a multi-line slot structure formed of two bent line slots and a straight-line slot. The first interval d1 is in a range of 0.001 to 0.038 wavelength of the lowest operating frequency of the first communication band 17. The radiating slot structure 131 is formed at the second conductor layer 12. The signal coupling line 132 is formed at the first conductor layer 11. The radiating slot structure 131 crosses the signal coupling line 132 which is spaced apart from the second conductor layer 12 by a coupling interval d3132. The radiating slot structure 141 is formed at the second conductor layer 12, and the signal coupling line 142 is also formed at the second conductor layer 12. The radiating slot structure 141 partially overlaps the signal coupling line 142 which is spaced apart from the second conductor layer 12 by a coupling interval d4142. Each of the coupling intervals d3132 and d4142 is in a range of 0.001 to 0.035 wavelength of the lowest operating frequency of the first communication band 17. The radiating slot structure 131 has an open end 1311 located at an edge 1221 of the second conductor layer 12 and spaced apart from the junction 12113 between the radiating slot structure 131 and the conjoined slot structure 121 by an open-slot interval d1331 being in a range of 0.01 to 0.29 wavelength of the lowest operating frequency of the first communication band 17. The radiating slot structure 141 has a closed end 1412 located at an edge 1222 of the second conductor layer 12 and spaced apart from the junction 12114 between the radiating slot structure 141 and the conjoined slot structure 121 by a close-slot interval d1441 being in a range of 0.05 to 0.59 wavelength of the lowest operating frequency of the first communication band 17. The length of each of the signal coupling lines 132 and 142 is in a range of 0.03 to 0.33 wavelength of the lowest operating frequency of the first communication band 17. A dielectric substrate or a multi-layer dielectric substrate could be formed or interposed between the second conductor layer 12 and the first conductor layer 11. The conjoined slot structure 121 could also be a linear slot structure, a square ring slot structure, a circular ring slot structure, an oval ring slot structure, a diamond ring slot structure, a circular slot structure, a semi-circular slot structure, an oval slot structure, a semi-oval slot structure, a square slot structure, a rectangular slot structure, a diamond slot structure, a quadrilateral slot structure, a polygonal slot structure or a combination thereof.

In order to achieve the effects of high integration and low profile, the present disclosure provides a highly-integrated multi-antenna array 1. With the design that both of the radiating slot structures 131 and 141 are formed at the second conductor layer 12 and the design that all of the conjoined conducting structures 111, 112, 113, 114, 115, 116, 117 and 118 electrically connect the first conductor layer 11 and the second conductor layer 12, the first conductor layer 11 could equivalently form a reflective layer of radiating energy and a shielding layer of surrounding coupling energy for the highly-integrated multi-antenna array 1, and therefore could successfully direct the radiating energy of the highly-integrated multi-antenna array 1 to be away from the interference of surrounding coupling energy. Moreover, with the design that the radiating slot structures 131 and 141 partially overlaps or crosses the signal coupling lines 132 and 142 respectively, and the design that the signal coupling lines 132 and 142 respectively are spaced apart from the second conductor layer 12 by coupling intervals d3132 and d4142 both being in a range of 0.001 to 0.035 wavelength of the lowest operating frequency of the first communication band 17 and with the design that a conjoined slot structure 121 is formed at the second conductor layer 12 and connects with all of radiating slot structures 131 and 141 respectively, the conjoined slot structure 121 could effectively reduce the equivalent parasitic capacitive effects of the highly-integrated multi-antenna array 1 and successfully compensate the coupling capacitive effects generated between the first conductor layer 11 and the second conductor layer 12. Therefore, the slot antennas 13 and 14 could respectively be excited to generate at least resonant modes 133 and 143 with good impedance matching covering at least one identical first communication band 17, and the first interval d1 would only need to be in a range of 0.001 to 0.038 wavelength of the lowest operating frequency of the first communication band 17. Therefore, the present disclosure could successfully achieve the effects of good impedance matching, high integration, low profile and thinness.

FIG. 1B is a curve diagram about return loss and isolation of a highly-integrated multi-antenna array 1 according to an embodiment of the present disclosure. The slot antenna 13 has a return loss curve 1332. The slot antenna 14 has a return loss curve 1432. The slot antennas 13 and 14 have an isolation curve 1314. The experiment is based on the following sizes: the first interval d1 is about 1.6 mm; the open-slot interval d1331 is about 10.3 mm; the close-slot interval d1441 is about 21.3 mm; the coupling interval d3132 is about 1.6 mm; the coupling interval d4142 is about 0.6 mm; the length of the signal coupling line 132 is about 13 mm, the length of the signal coupling line 142 is about 10 mm; the length of the bent line slot of the conjoined slot structure 121 is about 23 mm; the length of the straight-line slot of the conjoined slot structure 121 is about 14 mm. As indicated in FIG. 1B, the slot antenna 13 is excited to generate a resonant mode 133 with good impedance matching, the slot antenna 14 is excited to generate a resonant mode 143 with good impedance matching, and the resonant modes 133 and 143 cover at least one identical first communication band 17. In the present embodiment, the first communication band 17 is in a range of 3400-3600 MHz, and has a lowest operating frequency of 3400 MHz. As indicated in FIG. 1B, the isolation curve 1314 of the slot antennas 13 and 14 is higher than 10 dB in the first communication band 17, showing that the highly-integrated multi-antenna array 1 of the present embodiment could have satisfying performance in terms of impedance matching and isolation.

The operating communication band and the experimental data as illustrated in FIG. 1B are for proving the technical effects of the highly-integrated multi-antenna array 1 of FIG. 1 only, not for limiting the operating communication band, the application fields or the specifications that could be supported by the highly-integrated multi-antenna array of the present disclosure 1 in practical applications. One or multiple sets of the highly-integrated multi-antenna array 1 could be implemented in a communication device such as mobile communication device, wireless communication device, mobile operation device, computer device, telecommunication equipment, base station equipment, wireless access equipment, network equipment, or peripheral devices of a computer or a network.

Figure 2A:
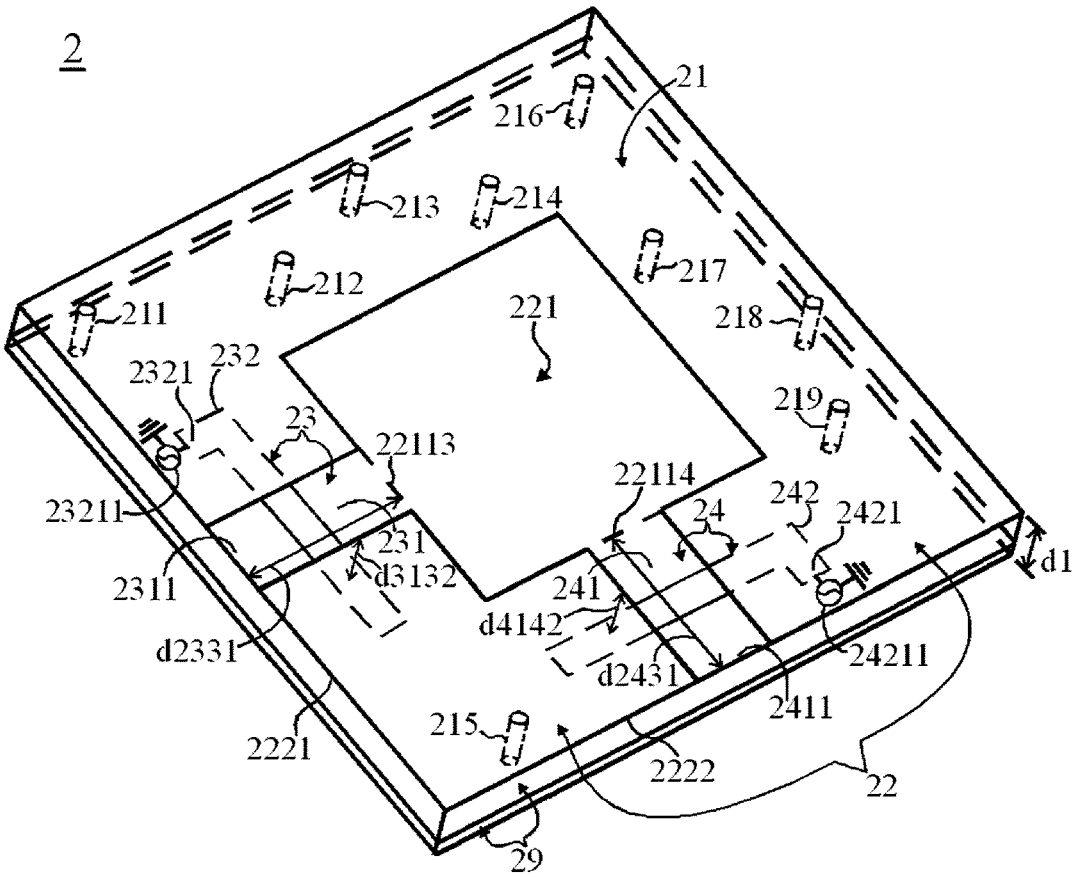
FIG. 2A is a structural diagram of a highly-integrated multi-antenna array 2 according to an embodiment of the present disclosure.
Figure 2B:
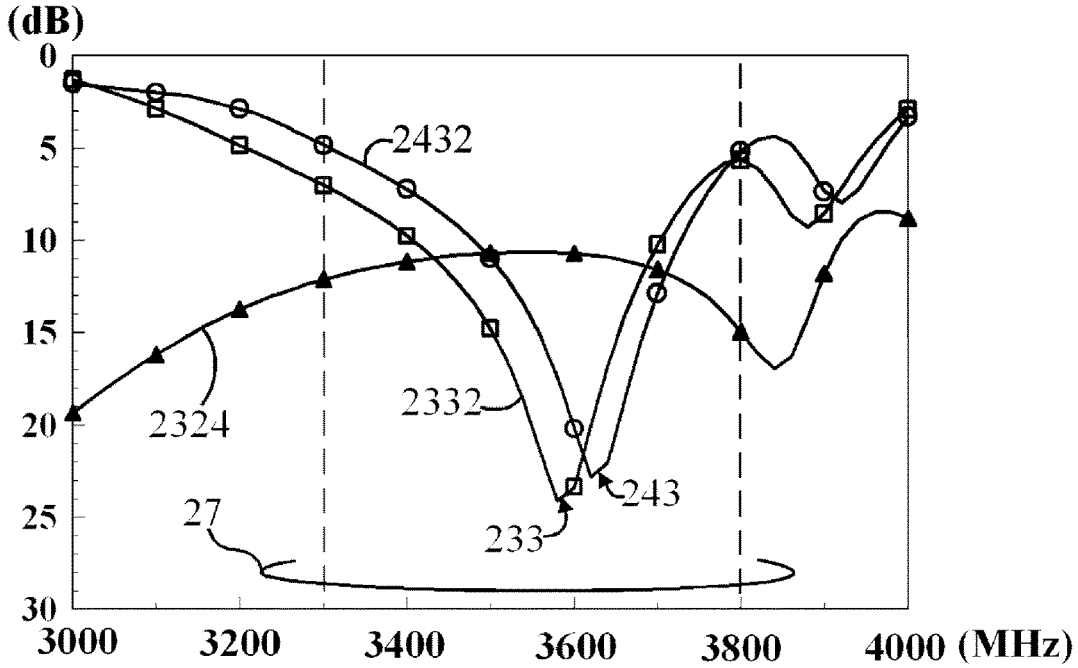
FIG. 2B is a curve diagram about return loss and isolation of a highly-integrated multi-antenna array 2 according to an embodiment of the present disclosure.

FIG. 2A is a structural diagram of a highly-integrated multi-antenna array 2 according to an embodiment of the present disclosure. As indicated in FIG. 2A, the highly-integrated multi-antenna array 2 includes a first conductor layer 21, a second conductor layer 22, a plurality of conjoined conducting structures 211, 212, 213, 214, 215, 216, 217, 218 and 219, a plurality of slot antennas 23 and 24, and a conjoined slot structure 221. The second conductor layer 22 is spaced apart from the first conductor layer 21 by a first interval d1. A multi-layer dielectric substrate 29 is formed between the second conductor layer 22 and the first conductor layer 21. All of the conjoined conducting structures 211, 212, 213, 214, 215, 216, 217, 218 and 219 electrically connect the first conductor layer 21 and the second conductor layer 22. All of the conjoined conducting structures 211, 212, 213, 214, 215, 216, 217, 218 and 219 are conductive vias. The slot antennas 23 and 24 respectively have radiating slot structures 231 and 241 and signal coupling lines 232 and 242. The radiating slot structures 231 and 241 respectively cross the signal coupling lines 232 and 242. Both of the radiating slot structures 231 and 241 are formed at the second conductor layer 22. The signal coupling lines 232 and 242 respectively are spaced apart from the second conductor layer 22 by coupling intervals d3132 and d4142. The signal coupling lines 232 and 242 respectively have signal feeding points 2321 and 2421 electrically coupled to signal sources 23211 and 24211. Each the signal sources 23211 and 24211 could be an impedance matching circuit, a transmission line, a micro-strip transmission line, a strip line, a substrate integrated waveguide, a coplanar waveguide, an amplifier circuit, an integrated circuit chip or an RF module. The slot antennas 23 and 24 respectively are excited to generate at least resonant modes 233 and 243 covering at least one identical first communication band 27 (as indicated in FIG. 2B). The conjoined slot structure 221 is formed at the second conductor layer 22 and connects with both of the radiating slot structures 231 and 241. The conjoined slot structure 221 is a square slot structure. The first interval d1 is in a range of 0.001 to 0.038 wavelength of the lowest operating frequency of the first communication band 27. The radiating slot structure 231 is formed at the second conductor layer 22. The signal coupling line 232 is integrated within the multi-layer dielectric substrate 29 and formed between the first conductor layer 21 and the second conductor layer 22. The radiating slot structure 231 crosses the signal coupling line 232 which is spaced apart from the second conductor layer 22 by a coupling interval d3132. The radiating slot structure 241 is formed at the second conductor layer 22, and the signal coupling line 242 is also integrated within the multi-layer dielectric substrate 29 and formed between the first conductor layer 21 and the second conductor layer 22. The radiating slot structure 241 crosses the signal coupling line 242 which is spaced apart from the second conductor layer 22 by a coupling interval d4142. Each of the coupling intervals d3132 and d4142 is in a range of 0.001 to 0.035 wavelength of the lowest operating frequency of the first communication band 27. The radiating slot structure 231 has an open end 2311 located at an edge 2221 of the second conductor layer 22 and spaced apart from the junction 22113 between the radiating slot structure 231 and the conjoined slot structure 221 by an open-slot interval d2331 being in a range of 0.01 to 0.29 wavelength of the lowest operating frequency of the first communication band 27. The radiating slot structure 241 has an open end 2411 located at an edge 2222 of the second conductor layer 22 and spaced apart from the junction 22114 between the radiating slot structure 241 and the conjoined slot structure 221 by an open-slot interval d2431 being in a range of 0.01 to 0.29 wavelength of the lowest operating frequency of the first communication band 27. The length of each of the signal coupling lines 232 and 242 is between 0.03 to 0.33 wavelength of the lowest operating frequency of the first communication band 27. The second conductor layer 22 could have another dielectric substrate disposed thereon, and the first conductor layer 21 could have another dielectric substrate disposed underneath. The conjoined slot structure 221 could be a linear slot structure, a multi-line slot structure, a square ring slot structure, a circular ring slot structure, an oval ring slot structure, a diamond ring slot structure, a circular slot structure, a semi-circular slot structure, an oval slot structure, a semi-oval slot structure, a rectangular slot structure, a diamond slot structure, a quadrilateral slot structure, a polygonal slot structure or a combination thereof.

The structure shapes and the arrangements of elements of the highly-integrated multi-antenna array 2 of FIG. 2A are not exactly identical to those of the highly-integrated multi-antenna array 1. However, with the same design that both of the radiating slot structures 231 and 241 are formed at the second conductor layer 22 and the design that all of the conjoined conducting structures 211, 212, 213, 214, 215, 216, 217, 218 and 219 electrically connect the first conductor layer 21 and the second conductor layer 22, the first conductor layer 21 still could also effectively form a reflective layer of radiating energy and a shielding layer of surrounding coupling energy for the highly-integrated multi-antenna array 2, and therefore could also successfully direct the radiating energy of the highly-integrated multi-antenna array 2 to be away from the interference of surrounding coupling energy. Moreover, with the design that the radiating slot structures 231 and 241 respectively cross the signal coupling lines 232 and 242, and the design that the signal coupling lines 232 and 242 respectively are spaced apart from the second conductor layer 22 by coupling intervals d3132 and d4142 both being in a range of 0.001 to 0.035 wavelength of the lowest operating frequency of the first communication band 27 and with the design that a conjoined slot structure 221 is formed at the second conductor layer 22 and connects with all of radiating slot structures 231 and 241 respectively, the conjoined slot structure 221 could also effectively reduce the equivalent parasitic capacitive effects of the highly-integrated multi-antenna array 2 and could also successfully compensate the coupling capacitive effects generated between the first conductor layer 21 and the second conductor layer 22. Therefore, the slot antennas 23 and 24 respectively could also be excited to generate at least resonant modes 233 and 243 with good impedance matching covering at least one identical first communication band 27 (as indicated in FIG. 2B), and the first interval d1 would also only need to be between 0.001 to 0.038 wavelength of the lowest operating frequency of the first communication band 27. Therefore, the highly-integrated multi-antenna array 2 of the present disclosure could also achieve the effects and characteristics of good impedance matching, high integration and thinness successfully.

FIG. 2B is a curve diagram about return loss and isolation of a highly-integrated multi-antenna array 2 according to an embodiment of the present disclosure. The slot antenna 23 has a return loss curve 2332. The slot antenna 24 has a return loss curve 2432. The slot antennas 23 and 24 have an isolation curve 2324. The experiment is based on the following sizes: the first interval d1 is about 1 mm; the open-slot interval d2331 is about 8.2 mm; the open-slot interval d2431 is about 8.2 mm; the coupling interval d3132 is about 0.3 mm; the coupling interval d4142 is about 0.3 mm; the length of the signal coupling line 232 is about 15 mm; the length of the signal coupling line 242 is about 15 mm; the rectangular slot structure of the conjoined slot structure 221 has an area about 327.6 $mm^2$. As indicated in FIG. 2B, the slot antennas 23 is excited to generate a resonant mode 233 with good impedance matching, the slot antennas 24 is excited to generate a resonant mode 243 with good impedance matching, and the resonant modes 233 and 243 cover at least one identical first communication band 27. In the present embodiment, the first communication band 27 is in a range of 3300-3800 MHz, and has a lowest operating frequency of 3300 MHz. As indicated in FIG. 2B, the isolation curve 2324 of the slot antennas 23 and 24 is higher than 11 dB in the first communication band 27, showing that the highly-integrated multi-antenna array 2 of the present embodiment could also achieve satisfying performance in terms of impedance matching and isolation.

The operating communication band and the experimental data as illustrated in FIG. 2B are for proving the technical effects of the highly-integrated multi-antenna array 2 of FIG. 2 only, not for limiting the operating communication band, the application fields or the specifications that could be supported by the highly-integrated multi-antenna array 2 of the present disclosure in practical applications. One or multiple sets of the highly-integrated multi-antenna array 2 could be implemented in a communication device such as mobile communication device, wireless communication device, mobile operation device, computer device, telecommunication equipment, base station equipment, wireless access equipment, network equipment, or peripheral devices of a computer or a network.

Figure 3A:
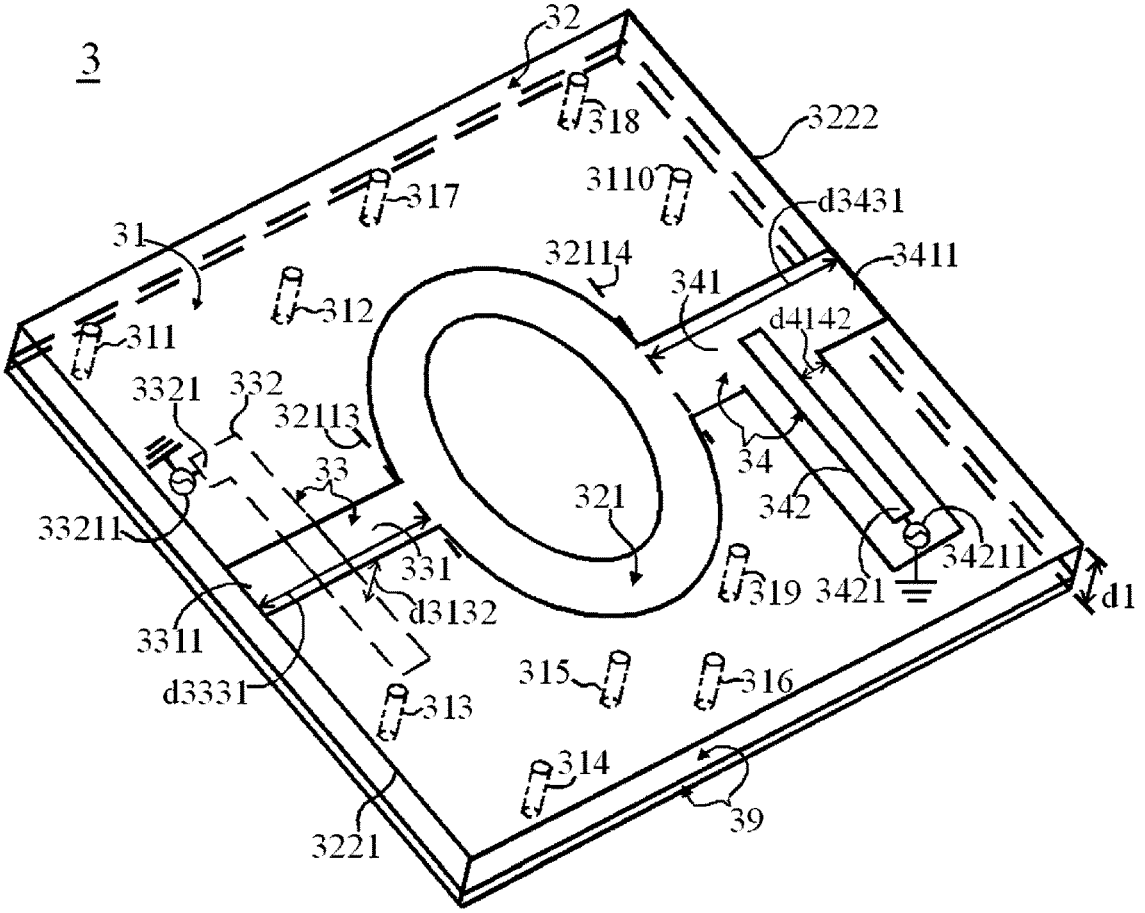
FIG. 3A is a structural diagram of a highly-integrated multi-antenna array 3 according to an embodiment of the present disclosure.
Figure 3B:
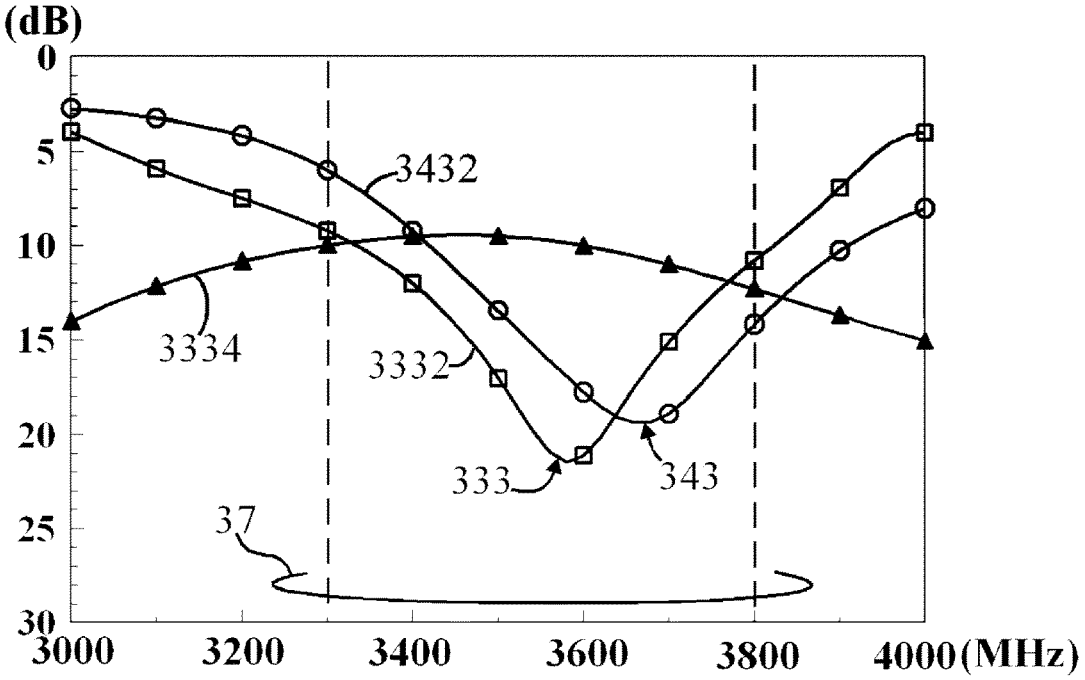
FIG. 3B is a curve diagram about return loss and isolation of a highly-integrated multi-antenna array 3 according to an embodiment of the present disclosure.

FIG. 3A is a structural diagram of a highly-integrated multi-antenna array 3 according to an embodiment of the present disclosure. As indicated in FIG. 3A, the highly-integrated multi-antenna array 3 includes a first conductor layer 31, a second conductor layer 32, a plurality of conjoined conducting structures 311, 312, 313, 314, 315, 316, 317, 318, 319 and 3110, a plurality of slot antennas 33 and 34, and a conjoined slot structure 321. The second conductor layer 32 is spaced apart from the first conductor layer 31 by a first interval d1. A multi-layer dielectric substrate 39 is formed between the second conductor layer 32 and the first conductor layer 31. All of the conjoined conducting structures 311, 312, 313, 314, 315, 316, 317, 318, 319 and 3110 electrically connect the first conductor layer 31 and the second conductor layer 32. All of the conjoined conducting structures 311, 312, 313, 314, 315, 316, 317, 318, 319 and 3110 are conductive vias. The slot antennas 33 and 34 respectively have radiating slot structures 331 and 341 and signal coupling lines 332 and 342. The radiating slot structure 331 and the signal coupling line 332 cross each other. The radiating slot structure 341 and the signal coupling line 342 partially overlap each other. Both of the radiating slot structures 331 and 341 are formed at the second conductor layer 32. The signal coupling lines 332 and 342 respectively are spaced apart from the second conductor layer 32 by coupling intervals d3132 and d4142. The signal coupling lines 332 and 342 respectively have signal feeding points 3321 and 3421 electrically coupled to signal sources 33211 and 34211. Each of the signal source 33211 and 34211 could be an impedance matching circuit, a transmission line, a micro-strip transmission line, a strip line, a substrate integrated waveguide, a coplanar waveguide, an amplifier circuit, an integrated circuit chip or an RF module. The slot antennas 33 and 34 respectively are excited to generate at least resonant modes 333 and 343 covering at least one identical first communication band 37 (as indicated in FIG. 3B). The conjoined slot structure 321 is formed at the second conductor layer 32 and connects with all of the radiating slot structures 331 and 341 respectively. The conjoined slot structure 321 is an oval ring slot structure enclosing an oval conductor area at the second conductor layer 32. The oval conductor area could electrically be coupled to other signal source or circuit. The first interval d1 is in a range of 0.001 to 0.038 wavelength of the lowest operating frequency of the first communication band 37. The radiating slot structure 331 is formed at the second conductor layer 32. The signal coupling line 332 is integrated within the multi-layer dielectric substrate 39 and formed between the first conductor layer 31 and the second conductor layer 32. The radiating slot structure 331 crosses the signal coupling line 332 which is spaced apart from the second conductor layer 32 by a coupling interval d3132. The radiating slot structure 341 is formed at the second conductor layer 32, and the signal coupling line 342 is also formed at the second conductor layer 32. The radiating slot structure 341 partly overlaps the signal coupling line 342 which is spaced apart from the second conductor layer 32 by a coupling interval d4142. Each of the coupling intervals d3132 and d4142 is in a range of 0.001 to 0.035 wavelength of the lowest operating frequency of the first communication band 37. The radiating slot structure 331 has an open end 3311 located at an edge 3221 of the second conductor layer 32 and spaced apart from the junction 32113 between the radiating slot structure 331 and the conjoined slot structure 321 by an open-slot interval d3331 being in a range of 0.01 to 0.29 wavelength of the lowest operating frequency of the first communication band 37. The radiating slot structure 341 has an open end 3411 located at an edge 3222 of the second conductor layer 32 and spaced apart from the junction 32114 between the radiating slot structure 341 and the conjoined slot structure 321 by an open-slot interval d3431 being in a range of 0.01 to 0.29 wavelength of the lowest operating frequency of the first communication band 37. The length of each of the signal coupling lines 332 and 342 is in a range of 0.03 to 0.33 wavelength of the lowest operating frequency of the first communication band 37. The second conductor layer 32 could have a dielectric substrate disposed thereon, and the first conductor layer 31 could have a dielectric substrate disposed underneath. The conjoined slot structure 321 could be a linear slot structure, a multi-line slot structure, a square ring slot structure, a circular ring slot structure, a diamond ring slot structure, a circular slot structure, a semi-circular slot structure, an oval slot structure, a semi-oval slot structure, a square slot structure, a rectangular slot structure, a diamond slot structure, a quadrilateral slot structure, a polygonal slot structure or a combination thereof.

The structure shapes and the arrangements of elements of the highly-integrated multi-antenna array 3 of FIG. 3A are not exactly identical to those of the highly-integrated multi-antenna array 1. However, with the same design that all of the radiating slot structures 331 and 341 are formed at the second conductor layer 32 and the design that all of the conjoined conducting structures 311, 312, 313, 314, 315, 316, 317, 318, 319 and 3110 electrically connect the first conductor layer 31 and the second conductor layer 32, the first conductor layer 31 still could also equivalently form a reflective layer of radiating energy and a shielding layer of surrounding coupling energy for the highly-integrated multi-antenna array 3, and therefore could also successfully direct the radiating energy of the highly-integrated multi-antenna array 3 to be away from the interference of surrounding coupling energy. Moreover, with the design that the radiating slot structures 331 and 341 respectively cross or partly overlap the signal coupling lines 332 and 342, and the design that the signal coupling lines 332 and 342 respectively are spaced apart from the second conductor layer 32 by coupling intervals d3132 and d4142 both being in a range of 0.001 to 0.035 wavelength of the lowest operating frequency of the first communication band 37 and with the design that a conjoined slot structure 321 is formed at the second conductor layer 32 and connects with all of radiating slot structures 331 and 341 respectively, the conjoined slot structure 321 could also effectively reduce the equivalent parasitic capacitive effects of the highly-integrated multi-antenna array 3 and could also successfully compensate the coupling capacitive effect generated between the first conductor layer 31 and the second conductor layer 32. Therefore, the slot antennas 33 and 34 respectively could also be excited to generate at least resonant modes 333 and 343 with good impedance matching covering at least one identical first communication band 37 (as indicated in FIG. 3B), and the first interval d1 would also only need to be in a range of 0.001 to 0.038 wavelength of the lowest operating frequency of the first communication band 37. Therefore, the highly-integrated multi-antenna array 3 of the present disclosure could also achieve the effects and characteristics of good impedance matching, high integration and low profile successfully.

FIG. 3B is a curve diagram about return loss and isolation of a highly-integrated multi-antenna array 3 according to an embodiment of the present disclosure. The slot antenna 33 has a return loss curve 3332. The slot antenna 34 has a return loss curve 3432. The slot antennas 33 and 34 have an isolation curve 3334. The experiment is based on the following sizes: the first interval d1 is about 1.6 mm; the open-slot interval d3331 is about 8.5 mm; the open-slot interval d3431 is about 9.3 mm; the coupling interval d3132 is about 0.8 mm; the coupling interval d4142 is about 0.9 mm; the length of the signal coupling line 332 is about 15 mm, the length of the signal coupling line 342 is about 10 mm; the ring length of the oval ring slot structure of the conjoined slot structure 321 is about 62.24 mm. As indicated in FIG. 3B, the slot antennas 33 is excited to generate a well-matched resonant mode 333, the slot antennas 34 is excited to generate a resonant mode 343 with good impedance matching, and the resonant modes 333 and 343 cover at least one identical first communication band 37. In the present embodiment, the first communication band 37 is in a range of 3300-3800 MHz, and has a lowest operating frequency of 3300 MHz. As indicated in FIG. 3B, the isolation curve 3324 of the slot antennas 33 and 34 is higher than 10 dB in the first communication band 37, showing that the highly-integrated multi-antenna array 3 of the present embodiment could also achieve satisfying performance in terms of impedance matching and isolation.

The operating communication band and the experimental data as illustrated in FIG. 3B are for proving the technical effects of the highly-integrated multi-antenna array 3 of FIG. 3 only, not for limiting the operating communication band, the application fields or the specifications that could be supported by the highly-integrated multi-antenna array 3 of the present disclosure in practical applications. One or multiple sets of the highly-integrated multi-antenna array 3 could be implemented in a communication device such as mobile communication device, wireless communication device, mobile operation device, computer device, telecommunication equipment, base station equipment, wireless access equipment, network equipment, or peripheral devices of a computer or a network.

Figure 4A:
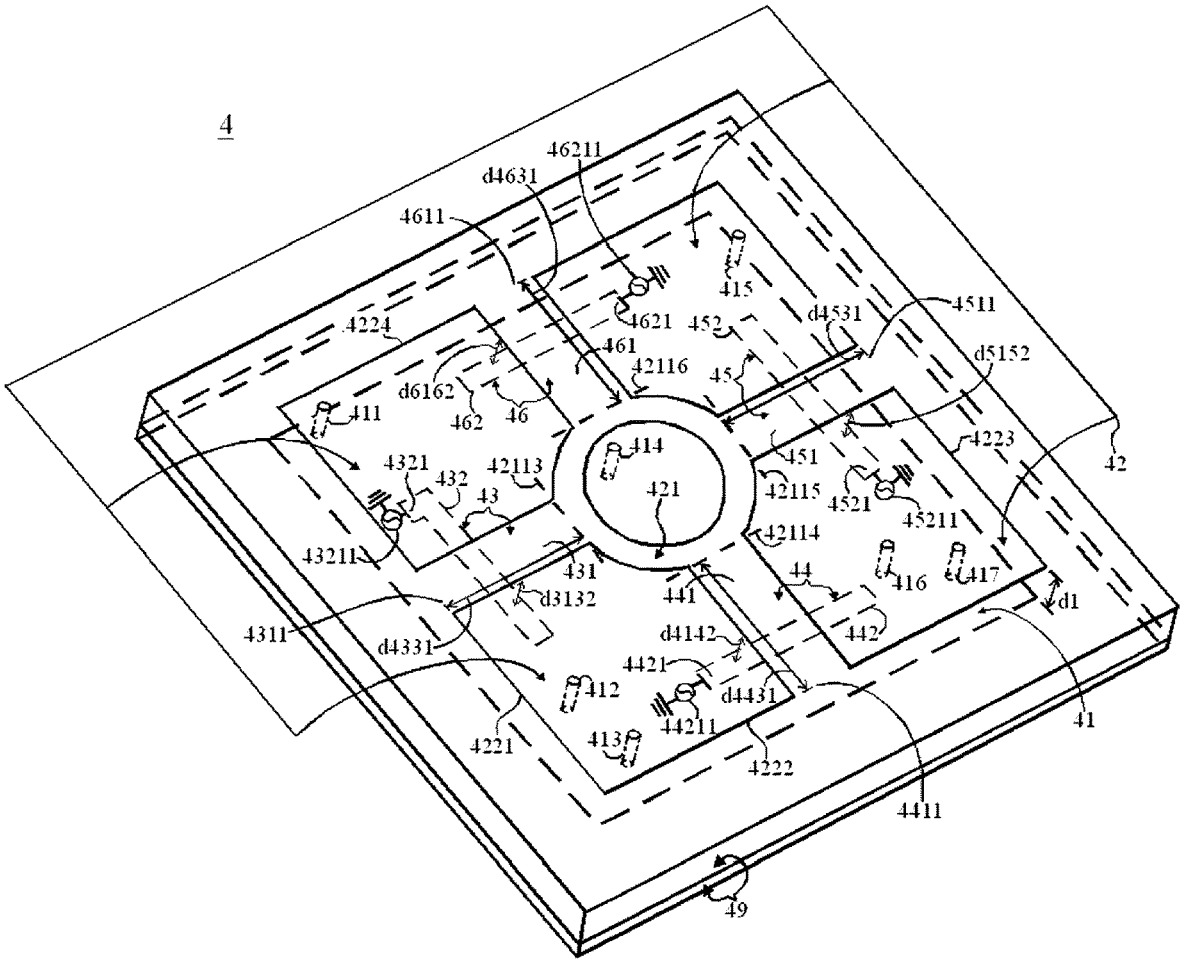
FIG. 4A is a structural diagram of a highly-integrated multi-antenna array 4 according to an embodiment of the present disclosure.
Figure 4B:
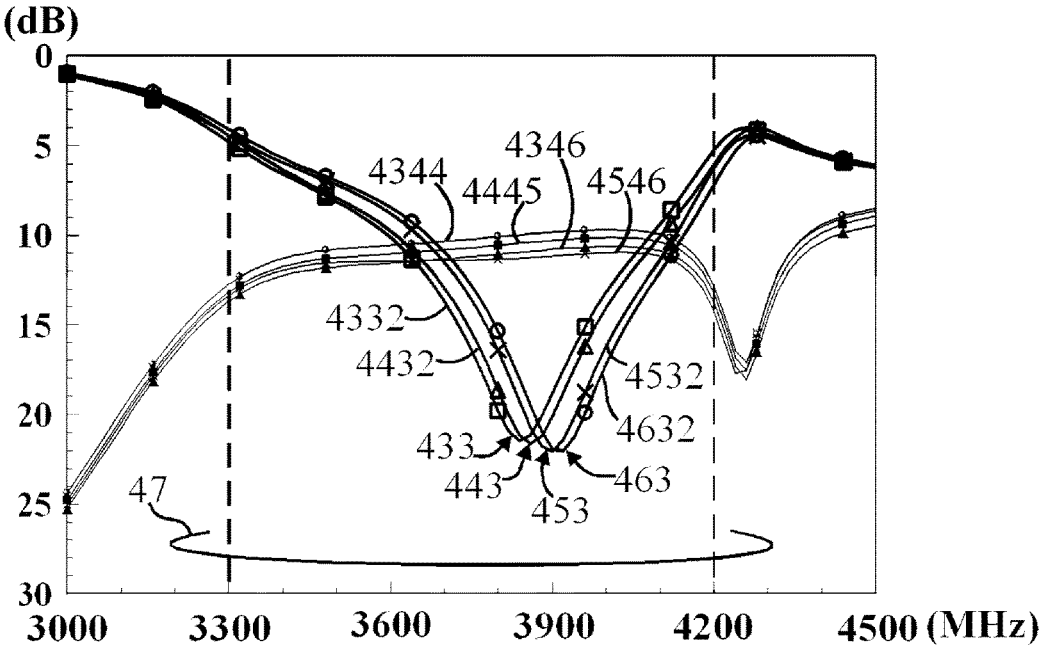
FIG. 4B is a curve diagram about return loss and isolation of a highly-integrated multi-antenna array 4 according to an embodiment of the present disclosure.

FIG. 4A is a structural diagram of a highly-integrated multi-antenna array 4 according to an embodiment of the present disclosure. As indicated in FIG. 4A, the highly-integrated multi-antenna array 4 comprises a first conductor layer 41, a second conductor layer 42, a plurality of conjoined conducting structures 411, 412, 413, 414, 415, 416 and 417, a plurality of slot antennas 43, 44, 45 and 46, and a conjoined slot structure 421. The second conductor layer 42 is spaced apart from the first conductor layer 41 by a first interval d1. A multi-layer dielectric substrate 49 is formed between the second conductor layer 42 and the first conductor layer 41. All of the conjoined conducting structures 411, 412, 413, 414, 415, 416 and 417 electrically connect the first conductor layer 41 and the second conductor layer 42. All of the conjoined conducting structures 411, 412, 413, 414, 415, 416 and 417 are conductive vias. The slot antennas 43, 44, 45 and 46 respectively have radiating slot structures 431, 441, 451 and 461 and signal coupling lines 432, 442, 452 and 462. The radiating slot structures 431, 441, 451 and 461 respectively cross the signal coupling lines 432, 442, 452 and 462. All of the radiating slot structures 431, 441, 451 and 461 are formed at the second conductor layer 42. The signal coupling lines 432, 442, 452 and 462 respectively are spaced apart from the second conductor layer 42 by coupling intervals d3132, d4142, d5152 and d6162. The signal coupling lines 432, 442, 452 and 462 respectively have signal feeding points 4321, 4421, 4521 and 4621 electrically coupled to signal sources 43211, 44211, 45211 and 46211. Each of the signal source 43211, 44211, 45211 and 46211 could be an impedance matching circuit, a transmission line, a micro-strip transmission line, a strip line, a substrate integrated waveguide, a coplanar waveguide, an amplifier circuit, an integrated circuit chip or an RF module. The slot antennas 43, 44, 45 and 46 respectively are excited to generate at least one resonant modes 433, 443, 453 and 463 covering at least one identical first communication band 47 (as indicated in FIG. 4B). The conjoined slot structure 421 is formed at the second conductor layer 42 and connects with all of the radiating slot structures 431, 441, 451 and 461 respectively. The conjoined slot structure 421 is a circular ring slot structure enclosing a circular conductor area at the second conductor layer 42. The circular conductor area could also be electrically coupled to other signal sources or circuits. The first interval d1 is in a range of 0.001 to 0.038 wavelength of the lowest operating frequency of the first communication band 47. The plurality of radiating slot structures 431, 441, 451 and 461 are formed at the second conductor layer 42. The signal coupling lines 432, 442, 452 and 462 are integrated within the multi-layer dielectric substrate 49 and formed between the first conductor layer 41 and the second conductor layer 42. The radiating slot structure 431 crosses the signal coupling line 432 which is spaced apart from the second conductor layer 42 by a coupling interval d3132. The radiating slot structure 441 crosses the signal coupling line 442 which is spaced apart from the second conductor layer 42 by a coupling interval d4142. The radiating slot structure 451 crosses the signal coupling line 452 which is spaced apart from the second conductor layer 42 by a coupling interval d5152. The radiating slot structure 461 crosses the signal coupling line 462 which is spaced apart from the second conductor layer 42 by a coupling interval d6162. Each of the coupling intervals d3132, d4142, d5152 and d6162 is in a range of 0.001 to 0.035 wavelength of the lowest operating frequency of the first communication band 47. The radiating slot structure 431 has an open end 4311 located at an edge 4221 of the second conductor layer 42 and spaced apart from the junction 42113 between the radiating slot structure 431 and the conjoined slot structure 421 by an open-slot interval d4331. The radiating slot structure 441 has an open end 4411 located at an edge 4222 of the second conductor layer 42 and spaced apart from the junction 42114 between the radiating slot structure 441 and the conjoined slot structure 421 by an open-slot interval d4431. The radiating slot structure 451 has an open end 4511 located at an edge 4223 of the second conductor layer 42 and spaced apart from the junction 42115 between the radiating slot structure 451 and the conjoined slot structure 421 by an open-slot interval d4531. The radiating slot structure 461 has an open end 4611 located at an edge 4224 of the second conductor layer 42 and spaced apart from the junction 42116 between the radiating slot structure 461 and the conjoined slot structure 421 by an open-slot interval d4631. Each of the open slot intervals d4331, d4431, d4531 and d4631 is in a range of 0.01 to 0.29 wavelength of the lowest operating frequency of the first communication band 47. The length of each of the signal coupling lines 432, 442, 452 and 462 is in a range of 0.03 to 0.33 wavelength of the lowest operating frequency of the first communication band 47. The second conductor layer 42 could also have a dielectric substrate disposed thereon, and the first conductor layer 41 could also have a dielectric substrate disposed underneath. The conjoined slot structure 421 could be a linear slot structure, a multi-line slot structure, a square ring slot structure, an oval ring slot structure, a diamond ring slot structure, a circular slot structure, a semi-circular slot structure, an oval slot structure, a semi-oval slot structure, a square slot structure, a rectangular slot structure, a diamond slot structure, a quadrilateral slot structure, a polygonal slot structure or a combination thereof.

The number of slot antennas, the structure shapes and the arrangements of elements of the highly-integrated multi-antenna array 4 of FIG. 4A are not exactly identical to those of the highly-integrated multi-antenna array 1. However, with the same design that all of the radiating slot structures 431, 441, 451 and 461 are formed at the second conductor layer 42 and the design that all of the conjoined conducting structures 411, 412, 413, 414, 415, 416 and 417 electrically connect the first conductor layer 41 and the second conductor layer 42, the first conductor layer 41 still could also equivalently form a reflective layer of radiating energy and a shielding layer of surrounding coupling energy for the highly-integrated multi-antenna array 4, and therefore could also successfully direct the radiating energy of the highly-integrated multi-antenna array 4 to be away from the interference of surrounding coupling energy. Moreover, with the design that the radiating slot structures 431, 441, 451 and 461 respectively cross the signal coupling lines 432, 442, 452 and 462, and the design that the signal coupling lines 432, 442, 452 and 462 respectively are spaced apart from the second conductor layer 42 by coupling intervals d3132, d4142, d5152 and d6162 being in a range of 0.001 to 0.035 wavelength of the lowest operating frequency of the first communication band 47 and with the design that a conjoined slot structure 421 is formed at the second conductor layer 42 and connects with all of radiating slot structures 431, 441, 451 and 461, the conjoined slot structure 421 could also effectively reduce the equivalent parasitic capacitive effects of the highly-integrated multi-antenna array 4 and could also successfully compensate the coupling capacitive effects generated between the first conductor layer 41 and the second conductor layer 42. Therefore, the slot antennas 43, 44, 45 and 46 respectively could also be excited to generate at least one resonant modes 433, 443, 453 and 463 with good impedance matching covering at least one identical first communication band 47 (as indicated in FIG. 4B), and the first interval d1 could also only need to be in a range of 0.001 to 0.038 wavelength of the lowest operating frequency of the first communication band 47. Therefore, the highly-integrated multi-antenna array 4 of the present disclosure could also achieve the effects and characteristics of good matching, high integration and low profile successfully.

FIG. 4B is a curve diagram about return loss and isolation of a highly-integrated multi-antenna array 4 according to an embodiment of the present disclosure. The slot antenna 43 has a return loss curve 4332. The slot antenna 44 has a return loss curve 4432. The slot antenna 45 has a return loss curve 4532. The slot antenna 46 has a return loss curve 4632. The slot antennas 43 and 44 have an isolation curve 4344. The slot antennas 44 and 45 have an isolation curve 4445. The slot antennas 45 and 46 have an isolation curve 4546. The slot antennas 43 and 46 have an isolation curve 4346. The experiment is based on the following sizes: the first interval d1 is about 1 mm; each of the open-slot intervals d4331, d4431, d4531 and d4631 is about 8.15 mm; each of the coupling intervals d3132, d4142, d5152 and d6162 is about 0.3 mm; The length of each of the signal coupling lines 432, 442, 452 and 462 is about 15 mm; the slot length of the circular ring slot structure of the conjoined slot structure 421 is about 79.64 mm. As indicated in FIG. 4B, the slot antennas 43 is excited to generate a resonant mode 433 with good impedance matching, the slot antennas 44 is excited to generate a resonant mode 443 with good impedance matching, the slot antennas 45 is excited to generate a resonant mode 453 with good impedance matching, and the slot antennas 46 is excited to generate a resonant mode 463 with good impedance matching. The plurality of resonant modes 433, 443, 453 and 463 cover at least one identical first communication band 47. In the present embodiment, the first communication band 47 is in a range of 3300-4200 MHz, and has a lowest operating frequency of 3300 MHz. As indicated in FIG. 4B, all of the isolation curves 4344, 4445, 4546, and 4346 of the slot antennas 43, 44, 45 and 46 are higher than 10 dB in the first communication band 47, showing that the highly-integrated multi-antenna array 4 of the present embodiment could also achieve satisfying performance in terms of impedance matching and isolation.

The operating communication band and the experimental data as illustrated in FIG. 4B are for proving the technical effects of the highly-integrated multi-antenna array 4 of FIG. 4 only, not for limiting the operating communication band, the application fields or the specifications that could be supported by the highly-integrated multi-antenna array 4 of the present disclosure in practical applications. One or multiple sets of the highly-integrated multi-antenna array 4 could be implemented in a communication device such as mobile communication device, wireless communication device, mobile operation device, computer device, telecommunication equipment, base station equipment, wireless access equipment, network equipment, or peripheral devices of a computer or a network.

Figure 5A:
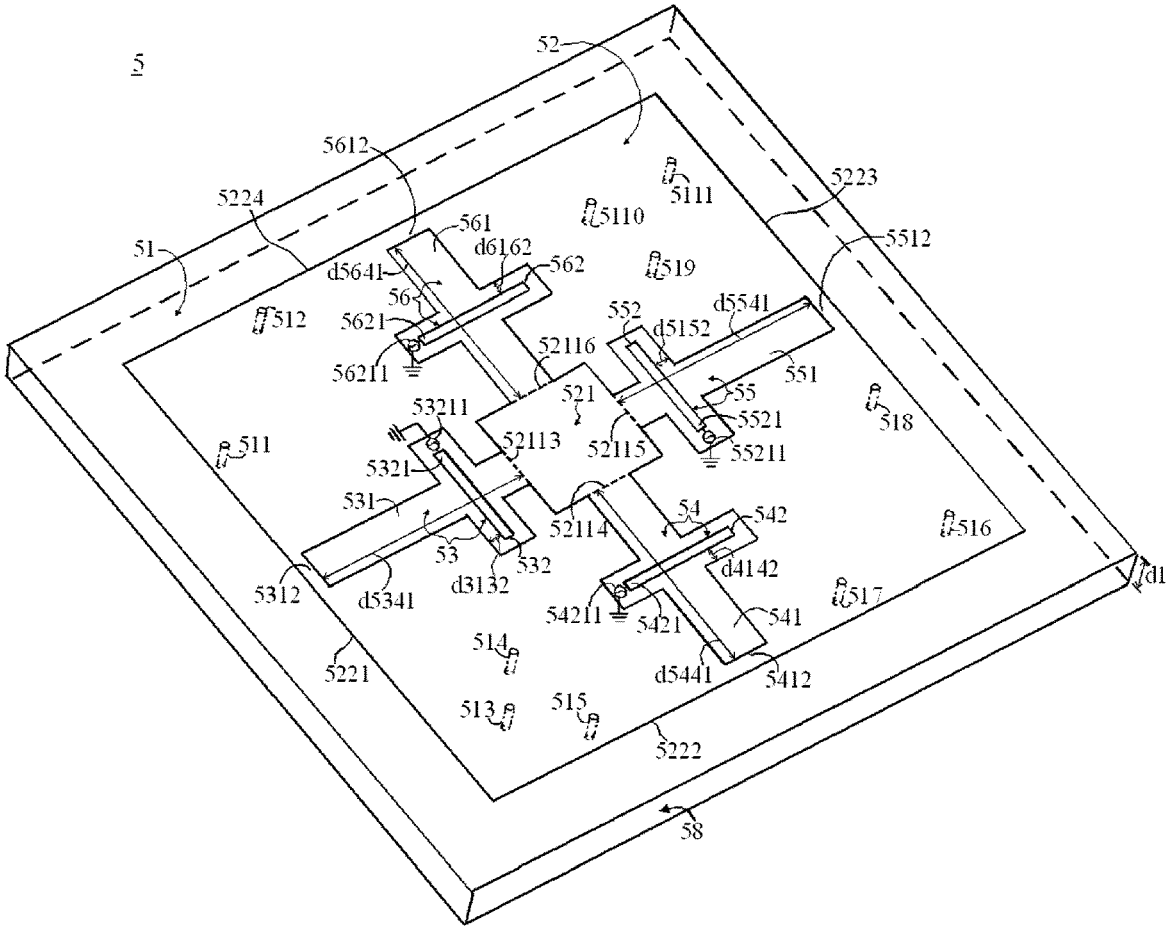
FIG. 5A is a structural diagram of a highly-integrated multi-antenna array 5 according to an embodiment of the present disclosure.
Figure 5B:
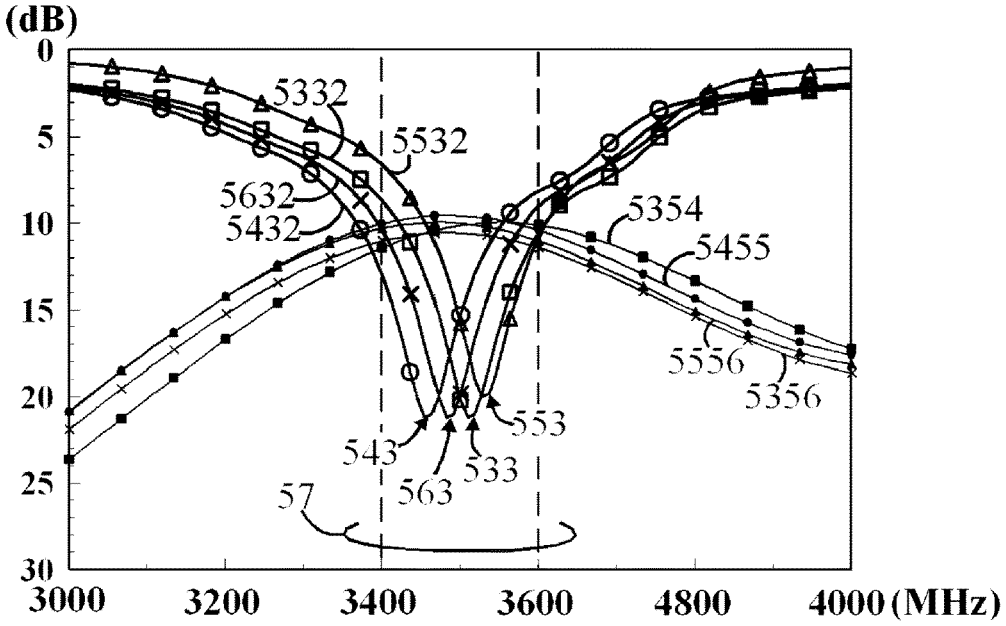
FIG. 5B is a curve diagram about return loss and isolation of a highly-integrated multi-antenna array 5 according to an embodiment of the present disclosure.

FIG. 5A is a structural diagram of a highly-integrated multi-antenna array 5 according to an embodiment of the present disclosure. As indicated in FIG. 5A, the highly-integrated multi-antenna array 5 comprises a first conductor layer 51, a second conductor layer 52, a plurality of conjoined conducting structures 511, 512, 513, 514, 515, 516, 517, 518, 519, 5110 and 5111, a plurality of slot antennas 53, 54, 55 and 56, and a conjoined slot structure 521. The second conductor layer 52 is spaced apart from the first conductor layer 51 by a first interval d1. A dielectric substrate 58 is formed between the second conductor layer 52 and the first conductor layer 51. All of the conjoined conducting structures 511, 512, 513, 514, 515, 516, 517, 518, 519, 5110 and 5111 electrically connect the first conductor layer 51 and the second conductor layer 52. All of the conjoined conducting structures 511, 512, 513, 514, 515, 516, 517, 518, 519, 5110 and 5111 are conductive vias. The slot antennas 53, 54, 55 and 56 respectively have radiating slot structures 531, 541, 551 and 561 and signal coupling lines 532, 542, 552 and 562. The radiating slot structures 531, 541, 551 and 561 partially overlap the signal coupling lines 532, 542, 552 and 562 respectively. All of the radiating slot structures 531, 541, 551 and 561 are formed at the second conductor layer 52. The signal coupling lines 532, 542, 552 and 562 respectively are spaced apart from the second conductor layer 52 by coupling intervals d3132, d4142, d5152 and d6162. The signal coupling lines 532, 542, 552 and 562 respectively have signal feeding points 5321, 5421, 5521 and 5621 electrically coupled to signal sources 53211, 54211, 5521 and 56211. Each of the signal sources 53211, 54211, 5521 and 56211 could be an impedance matching circuit, a transmission line, a micro-strip transmission line, a strip line, a substrate integrated waveguide, a coplanar waveguide, an amplifier circuit, an integrated circuit chip or an RF module. The slot antennas 53, 54, 55 and 56 are respectively excited to generate at least resonant modes 533, 543, 553 and 563 covering at least one identical first communication band 57 (as indicated in FIG. 5B). The conjoined slot structure 521 is formed at the second conductor layer 52 and connects with all of the radiating slot structures 531, 541, 551 and 561 respectively. The conjoined slot structure 521 is a square slot structure. The first interval d1 is in a range of 0.001 to 0.038 wavelength of the lowest operating frequency of the first communication band 57. All of the radiating slot structures 531, 541, 551 and 561 are formed at the second conductor layer 52. Each of the signal coupling lines 532, 542, 552 and 562 is also formed at the second conductor layer 52. The radiating slot structure 531 partially overlaps the signal coupling line 532 which is spaced apart from the second conductor layer 52 by a coupling interval d3132. The radiating slot structure 541 partially overlaps the signal coupling line 542 which is spaced apart from the second conductor layer 52 by a coupling interval d4142. The radiating slot structure 551 partially overlaps the signal coupling line 552 which is spaced apart from the second conductor layer 52 by a coupling interval d5152. The radiating slot structure 561 partially overlaps the signal coupling line 562 which is spaced apart from the second conductor layer 52 by a coupling interval d6162. Each of the coupling intervals d3132, d4142, d5152 and d6162 is in a range of 0.001 to 0.035 wavelength of the lowest operating frequency of the first communication band 57. The radiating slot structure 531 has a closed end 5312 located at an edge 5221 of the second conductor layer 52 and spaced apart from the junction 52113 between the radiating slot structure 531 and the conjoined slot structure 521 by a close-slot interval d5341. The radiating slot structure 541 has a closed end 5412 located at an edge 5222 of the second conductor layer 52 and spaced apart from the junction 52114 between the radiating slot structure 541 and the conjoined slot structure 521 by a close-slot interval d5441. The radiating slot structure 551 has a closed end 5512 located at an edge 5223 of the second conductor layer 52 and spaced apart from the junction 52115 between the radiating slot structure 551 and the conjoined slot structure 521 by a close-slot interval d5541. The radiating slot structure 561 has a closed end 5612 located at an edge 5224 of the second conductor layer 52 and spaced apart from the junction 52116 between the radiating slot structure 561 and the conjoined slot structure 521 by a close-slot interval d5641. Each of the close-slot intervals d5341, d5441, d5541 and d5641 is in a range of 0.05 to 0.59 wavelength of the lowest operating frequency of the first communication band 57. The length of each of the signal coupling lines 532, 542, 552 and 562 is in a range of 0.03 to 0.33 wavelength of the lowest operating frequency of the first communication band 57. The second conductor layer 52 could also have a dielectric substrate disposed thereon, and the first conductor layer 51 could also have a dielectric substrate disposed underneath. The conjoined slot structure 521 could be a linear slot structure, a multi-line slot structure, a square ring slot structure, a circular ring slot structure, an oval ring slot structure, a diamond ring slot structure, a circular slot structure, a semi-circular slot structure, an oval slot structure, a semi-oval slot structure, a rectangular slot structure, a diamond slot structure, a quadrilateral slot structure, a polygonal slot structure or a combination thereof.

The number of slot antennas, the structure shapes and the arrangements of elements of the highly-integrated multi-antenna array 5 of FIG. 5A are not exactly identical to those of the highly-integrated multi-antenna array 1. However, with the same design that all of the radiating slot structures 531, 541, 551 and 561 are formed at the second conductor layer 52 and the design that all of the conjoined conducting structures 511, 512, 513, 514, 515, 516, 517, 518, 519, 5110 and 5111 electrically connect the first conductor layer 51 and the second conductor layer 52, the first conductor layer 51 still could also equivalently form a reflective layer of radiating energy and a shielding layer of surrounding coupling energy for the highly-integrated multi-antenna array 5, and therefore could also successfully direct the radiating energy of the highly-integrated multi-antenna array 5 to be away from the interference of surrounding coupling energy. Moreover, with the design that the radiating slot structures 531, 541, 551 and 561 partially overlap the signal coupling lines 532, 542, 552 and 562 respectively, and the design that the signal coupling lines 532, 542, 552 and 562 are respectively spaced apart from the second conductor layer 52 by coupling intervals d3132, d4142, d5152 and d6162, each of the coupling intervals d3132, d4142, d5152 and d6162 is in a range of 0.001 to 0.035 wavelength of the lowest operating frequency of the first communication band 57, and with the design that a conjoined slot structure 521 is formed at the second conductor layer 52 and connects with all of radiating slot structures 531, 541, 551 and 561, the conjoined slot structure 521 could also effectively reduce the equivalent parasitic capacitive effects of the highly-integrated multi-antenna array 5 and could also successfully compensate the coupling capacitive effects generated between the first conductor layer 51 and the second conductor layer 52. Therefore, the slot antennas 53, 54, 55 and 56 could also be respectively excited to generate at least resonant modes 533, 543, 553 and 563 with good impedance matching covering at least one identical first communication band 57 (as indicated in FIG. 5B), and the first interval d1 would also only need to be in a range of 0.001 to 0.038 wavelength of the lowest operating frequency of the first communication band 57. Therefore, the highly-integrated multi-antenna array 5 of the present disclosure could also achieve the effects and characteristics of good matching, high integration, low profile or thin type successfully.

FIG. 5B is a curve diagram about return loss and isolation of a highly-integrated multi-antenna array 5 according to an embodiment of the present disclosure. The slot antenna 53 has a return loss curve 5332. The slot antenna 54 has a return loss curve 5432. The slot antenna 55 has a return loss curve 5532. The slot antenna 56 has a return loss curve 5632. The slot antennas 53 and 54 have an isolation curve 5354. The slot antennas 54 and 55 have an isolation curve 5455. The slot antennas 55 and 56 have an isolation curve 5556. The slot antennas 53 and 56 have an isolation curve 5356. The experiment is based on the following sizes: the first interval d1 is about 1.6 mm; each of the close-slot intervals d5341, d5441, d5541 and d5641 is about 17.5 mm; each of the coupling intervals d3132, d4142, d5152 and d6162 is about 0.5 mm; The length of each of the signal coupling lines 532, 542, 552 and 562 is about 15 mm; the rectangular slot structure of the conjoined slot structure 521 has an area about 106.1 $mm^2$. As indicated in FIG. 5B, the slot antennas 53 is excited to generate a resonant mode 533 with good impedance matching, the slot antennas 54 is excited to generate a resonant mode 543 with good impedance matching, the slot antennas 55 is excited to generate a resonant mode 553 with good impedance matching, the slot antennas 56 is excited to generate a resonant mode 563 with good impedance matching, and the resonant modes 533, 543, 553 and 563 cover at least one identical first communication band 57. In the present embodiment, the first communication band 57 is in a range of 3400-3600 MHz, and has a lowest operating frequency of 3400 MHz. As indicated in FIG. 5B, each of the isolation curve 5354, 5455, 5556, 5356 of the plurality of slot antennas 53, 54, 55 and 56 is higher than 9.5 dB in the first communication band 57, showing that the highly-integrated multi-antenna array 5 of the present embodiment could also achieve satisfying performance in terms of impedance matching and isolation.

The operating communication band and the experimental data as illustrated in FIG. 5B are for proving the technical effects of the highly-integrated multi-antenna array 5 of FIG. 5 only, not for limiting the operating communication band, the application fields or the specifications that could be supported by the highly-integrated multi-antenna array 5 of the present disclosure in actual application. One or multiple sets of the highly-integrated multi-antenna array 5 could be implemented in a communication device such as mobile communication device, wireless communication device, mobile operation device, computer device, telecommunication equipment, base station equipment, wireless access equipment, network equipment, or peripheral devices of a computer or a network.

Figure 6:
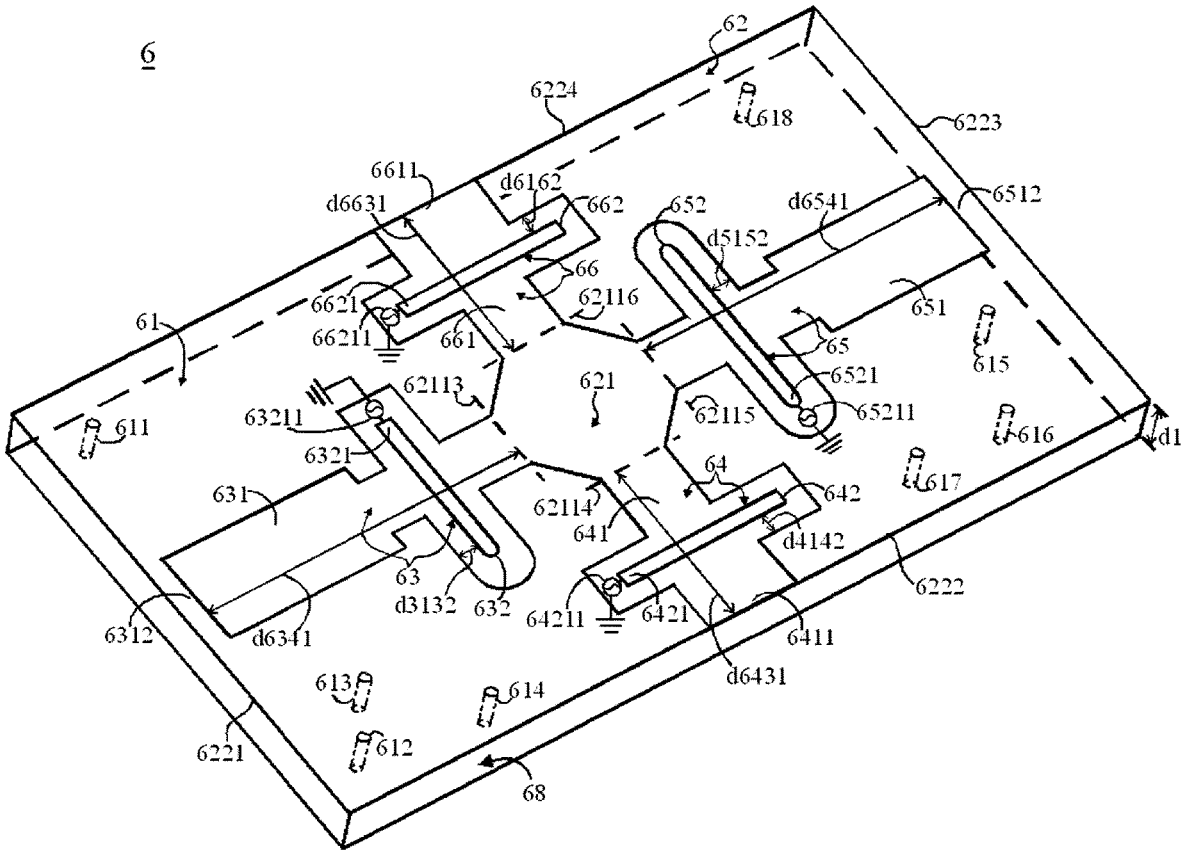
FIG. 6 is a structural diagram of a highly-integrated multi-antenna array 6 according to an embodiment of the present disclosure.

FIG. 6 is a structural diagram of a highly-integrated multi-antenna array 6 according to an embodiment of the present disclosure. As indicated in FIG. 6, the highly-integrated multi-antenna array 6 includes a first conductor layer 61, a second conductor layer 62, a plurality of conjoined conducting structures 611, 612, 613, 614, 615, 616, 617 and 618, a plurality of slot antennas 63, 64, 65 and 66, and a conjoined slot structure 621. The second conductor layer 62 is spaced apart from the first conductor layer 61 by a first interval d1. A dielectric substrate 68 is formed between the second conductor layer 62 and the first conductor layer 61. All of the conjoined conducting structures 611, 612, 613, 614, 615, 616, 617 and 618 electrically connect the first conductor layer 61 and the second conductor layer 62. All of the conjoined conducting structures 611, 612, 613, 614, 615, 616, 617 and 618 are conductive vias.

The slot antennas 63, 64, 65 and 66 respectively have radiating slot structures 631, 641, 651 and 661 and signal coupling lines 632, 642, 652 and 662. The radiating slot structures 631, 641, 651 and 661 partially overlap the signal coupling lines 632, 642, 652 and 662 respectively. All of the radiating slot structures 631, 641, 651 and 661 are formed at the second conductor layer 62. The signal coupling lines 632, 642, 652 and 662 respectively are spaced apart from the second conductor layer 62 by coupling intervals d3132, d4142, d5152 and d6162. The signal coupling lines 632, 642, 652 and 662 respectively have signal feeding points 6321, 6421, 6521 and 6621 electrically coupled to signal sources 63211, 64211, 65211 and 66211. Each of the signal sources 63211, 64211, 65211 and 66211 could be an impedance matching circuit, a transmission line, a micro-strip transmission line, a strip line, a substrate integrated waveguide, a coplanar waveguide, an amplifier circuit, an integrated circuit chip or an RF module. The slot antennas 63, 64, 65 and 66 respectively are excited to generate at least one resonant mode covering at least one identical first communication band. The conjoined slot structure 621 is formed at the second conductor layer 62 and connects with all of the radiating slot structures 631, 641, 651 and 661 respectively. The conjoined slot structure 621 is a polygonal slot structure. The first interval d1 is in a range of 0.001 to 0.038 wavelength of the lowest operating frequency of the first communication band. All of the radiating slot structures 631, 641, 651 and 661 are formed at the second conductor layer 62. Each of the signal coupling lines 632, 642, 652 and 662 is also formed at the second conductor layer 62. The radiating slot structure 631 partially overlaps the signal coupling line 632 which is spaced apart from the second conductor layer 62 by a coupling interval d3132. The radiating slot structure 641 partially overlaps the signal coupling line 642 which is spaced apart from the second conductor layer 62 by a coupling interval d4142. The radiating slot structure 651 partially overlaps the signal coupling line 652 which is spaced apart from the second conductor layer 62 by a coupling interval d5152. The radiating slot structure 661 partially overlaps the signal coupling line 662 which is spaced apart from the second conductor layer 62 by a coupling interval d6162. Each of the coupling intervals d3132, d4142, d5152 and d6162 is in a range of 0.001 to 0.035 wavelength of the lowest operating frequency of the first communication band. The radiating slot structure 631 has a closed end 6312 located at an edge 6221 of the second conductor layer 62 and spaced apart from the junction 62113 between the radiating slot structure 631 and the conjoined slot structure 621 by a close-slot interval d6341. The radiating slot structure 641 has an open end 6411 located at an edge 6222 of the second conductor layer 62 and spaced apart from the junction 62114 between the radiating slot structure 641 and the conjoined slot structure 621 by an open-slot interval d6431. The radiating slot structure 651 has a closed end 6512 located at an edge 6223 of the second conductor layer 62 and spaced apart from the junction 62115 between the radiating slot structure 651 and the conjoined slot structure 621 by a close-slot interval d6541. The radiating slot structure 661 has an open end 6611 located at an edge 6224 of the second conductor layer 62 and spaced apart from the junction 62116 between the radiating slot structure 661 and the conjoined slot structure 621 by an open-slot interval d6631. Each of the open slot intervals d6431 and d6631 is in a range of 0.01 to 0.29 wavelength of the lowest operating frequency of the first communication band. Each of the close-slot intervals d6341 and d6541 is in a range of 0.05 to 0.59 wavelength of the lowest operating frequency of the first communication band. The length of each of the signal coupling lines 632, 642, 652 and 662 is in a range of 0.03 to 0.33 wavelength of the lowest operating frequency of the first communication band. The second conductor layer 62 could have a dielectric substrate disposed thereon, and the first conductor layer 61 could have a dielectric substrate disposed underneath. The conjoined slot structure 621 could be a linear slot structure, a multi-line slot structure, a square ring slot structure, a circular ring slot structure, an oval ring slot structure, a diamond ring slot structure, a circular slot structure, a semi-circular slot structure, an oval slot structure, a semi-oval slot structure, a square slot structure, a rectangular slot structure, a diamond slot structure, a quadrilateral slot structure or a combination thereof.

The number of slot antennas, the structure shapes and the arrangements of elements of the highly-integrated multi-antenna array 6 of FIG. 6A are not exactly identical to those of the highly-integrated multi-antenna array 1. However, with the same design that all of the radiating slot structures 631, 641, 651 and 661 are formed at the second conductor layer 62 and the design that all of the conjoined conducting structures 611, 612, 613, 614, 615, 616, 617 and 618 electrically connect the first conductor layer 61 and the second conductor layer 62, the first conductor layer 61 could also equivalently form a reflective layer of radiating energy and a shielding layer of surrounding coupling energy for the highly-integrated multi-antenna array 6, and therefore could also successfully direct the radiating energy of the highly-integrated multi-antenna array 6 to be away from the interference of surrounding coupling energy. Moreover, with the design that the radiating slot structures 631, 641, 651 and 661 partially overlap the signal coupling lines 632, 642, 652 and 662 respectively, the design that the signal coupling lines 632, 642, 652 and 662 respectively are spaced apart from the second conductor layer 62 by coupling intervals d3132, d4142, d5152 and d6162, and each of the coupling intervals d3132, d4142, d5152 and d6162 is in a range of 0.001 to 0.035 wavelength of the lowest operating frequency of the first communication band and with the design that a conjoined slot structure 621 is formed at the second conductor layer 62 and connects with all of radiating slot structures 631, 641, 651 and 661, the conjoined slot structure 621 could also effectively reduce the equivalent parasitic capacitive effects of the highly-integrated multi-antenna array 6 and could also successfully compensate the coupling capacitive effects generated between the first conductor layer 61 and the second conductor layer 62. Therefore, the slot antennas 63, 64, 65 and 66 respectively could also be excited to generate at least one resonant mode with good impedance matching covering at least one identical first communication band, and the first interval d1 would only need to be in a range of 0.001 to 0.038 wavelength of the lowest operating frequency of the first communication band. Therefore, the highly-integrated multi-antenna array 6 of the present disclosure also could achieve the effects and characteristics of good matching, high integration, low profile and thin type successfully.

One or multiple sets of the highly-integrated multi-antenna array 6 could be implemented in a communication device such as mobile communication device, wireless communication device, mobile operation device, computer device, telecommunication equipment, base station equipment, wireless access equipment, network equipment, or peripheral devices of a computer or a network.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A highly-integrated multi-antenna array, comprising:

a first conductor layer;

a second conductor layer spaced apart from the first conductor layer by a first interval;

a plurality of conjoined conducting structures electrically connecting the first conductor layer and the second conductor layer;

a plurality of slot antennas, wherein, each of the slot antennas has a radiating slot structure and a signal coupling line, which partially overlap or cross each other, all of the radiating slot structures are formed at the second conductor layer, each of the signal coupling lines is spaced apart from the second conductor layer by a coupling interval and has a signal feeding point, and each of the slot antennas is excited to generate at least one resonant mode covering at least one identical first communication band; and a conjoined slot structure formed at the second conductor layer and connecting with all of the radiating slot structures;

wherein, the first interval is in a range of 0.001 to 0.038 wavelength of the lowest operating frequency of the first communication band;

wherein, the coupling interval is in a range of 0.001 to 0.035 wavelength of the lowest operating frequency of the first communication band; and wherein, the radiating slot structure has an open end located at an edge of the second conductor layer, and the signal coupling lines do not overlap and cross each other.

2. The highly-integrated multi-antenna array according to claim 1, wherein, the signal coupling line is formed at the first conductor layer, the second conductor layer or interposed between the first conductor layer and the second conductor layer.

3. The highly-integrated multi-antenna array according to claim 1, wherein, a dielectric substrate is formed between the second conductor layer and the first conductor layer.

4. The highly-integrated multi-antenna array according to claim 1, wherein, a multi-layer dielectric substrate is formed between the second conductor layer and the first conductor layer.

5. The highly-integrated multi-antenna array according to claim 4, wherein, the signal coupling line is integrated within the multi-layer dielectric substrate.

6. The highly-integrated multi-antenna array according to claim 1, wherein, the open end is spaced apart from a junction between the radiating slot structure and the conjoined slot structure by an open-slot interval being in a range of 0.01 to 0.29 wavelength of the lowest operating frequency of the first communication band.

7. The highly-integrated multi-antenna array according to claim 1, wherein, the radiating slot structure has a closed end located at another edge of the second conductor layer, and the closed end is spaced apart from a junction between the radiating slot structure and the conjoined slot structure by a close-slot interval being in a range of 0.05 to 0.59 wavelength of the lowest operating frequency of the first communication band lowest operating frequency.

8. The highly-integrated multi-antenna array according to claim 1, wherein, the length of the signal coupling line is in a range of 0.03 to 0.33 wavelength of the lowest operating frequency of the first communication band.

9. The highly-integrated multi-antenna array according to claim 1, wherein, the conjoined slot structure is a linear slot structure, a multi-line slot structure, a square ring slot structure, a circular ring slot structure, an oval ring slot structure, a diamond ring slot structure, a circular slot structure, a semi-circular slot structure, an oval slot structure, a semi-oval slot structure, a square slot structure, a rectangular slot structure, a diamond slot structure, a quadrilateral slot structure, a polygonal slot structure or a combination thereof.

10. The highly-integrated multi-antenna array according to claim 1, wherein, the conjoined conducting structures are conductive wires or conductive vias.

11. The highly-integrated multi-antenna array according to claim 1, wherein, each of the signal feeding points is electrically coupled to a signal source.

12. The highly-integrated multi-antenna array according to claim 11, wherein, the signal source is an impedance matching circuit, a transmission line, a micro-strip transmission line, a strip line, a substrate integrated waveguide, a coplanar waveguide, an amplifier circuit, an integrated circuit chip or an RF module.

* * * * *